US010213800B2

(12) United States Patent
Chen

(10) Patent No.: US 10,213,800 B2
(45) Date of Patent: Feb. 26, 2019

(54) SPRAY HEAD

(71) Applicant: SHIN TAI SPURT WATER OF THE GARDEN TOOLS CO., LTD., Lu-Kang Town, Chang-Hua Hsien (CN)

(72) Inventor: Chin-Yuan Chen, Chang-Hua Hsien (TW)

(73) Assignee: SHIN TAI SPURT WATER OF THE GARDEN TOOLS CO., LTD., Chang Hua County (TW)

( * ) Notice: Subject to any disclaimer, the term of this patent is extended or adjusted under 35 U.S.C. 154(b) by 62 days.

(21) Appl. No.: 15/625,527

(22) Filed: Jun. 16, 2017

(65) Prior Publication Data

US 2018/0361414 A1 Dec. 20, 2018

(51) Int. Cl.

| | |
|---|---|
| ***B05B 1/02*** | (2006.01) |
| ***B05B 9/01*** | (2006.01) |
| ***B05B 12/00*** | (2018.01) |
| ***B05B 1/30*** | (2006.01) |

(52) U.S. Cl.

CPC ..... *B05B 12/002* (2013.01); *B05B 1/02* (2013.01); *B05B 1/3026* (2013.01); *B05B 9/01* (2013.01)

(58) Field of Classification Search

CPC ..... B05B 12/002; B05B 1/02; B05B 1/06; B05B 1/3026; B05B 9/01

USPC ..... 239/526, 538, 539

See application file for complete search history.

(56) References Cited

U.S. PATENT DOCUMENTS

| | | | | |
|---|---|---|---|---|
| 3,756,516 | A * | 9/1973 | Trnka | B05B 1/3073 239/456 |
| 6,367,716 | B1 * | 4/2002 | Wang | B05B 1/3026 239/525 |
| D824,492 | S * | 7/2018 | Chen | D23/223 |
| 2012/0325934 | A1 * | 12/2012 | DeLorme | B05B 1/3013 239/526 |
| 2013/0193236 | A1 * | 8/2013 | Ye | B05B 9/01 239/526 |
| 2015/0343467 | A1 * | 12/2015 | Chen | B05B 9/01 239/526 |

* cited by examiner

*Primary Examiner* — Jason J Boeckmann

(57) ABSTRACT

A spray head includes a main body, a central shaft, a securing ring, a spout and a knob. The main body has a handle and a chamber, the chamber provided with a connecting opening allowing the central shaft to be inserted thereof. A disk body is disposed between the connecting section and the sleeve, the central shaft entering into the main body through the connecting opening, and the sleeve inserted into the chamber and engaging with the stepped edge such that the connecting section extends out of the chamber. The spout is provided with an outer shell and an inner tube. The knob has a stopper, and an end of the stopper has a screw, the screw of the knob inserted from the cone of the spout and engaging with the threaded aperture of the inner tube of the central shaft.

7 Claims, 7 Drawing Sheets

SPRAY HEAD

BACKGROUND OF INVENTION

1. Field of Invention

The present invention relates to a spray head, and more particularly to a spray head with various water flows.

2. Description of Related Art

Current known water spray head as shown in FIGS. 6 and 7, contains: a main body 80 and a spout 90. The main body 80 has a handle 81 and a chamber 82, and a front end of the chamber 82 is coupled with a discharge column 83 provided with a valve rod 84 having a water stop pad 841. Another end of the valve rod 84 extends out from the main body 80 and then combined with a hinge member 85 which is pivoted on the handle 81. The valve rod 84 is driven in the chamber 82 to control the opening and closing of the water flow. Furthermore, a spring 86 is sandwiched between the valve rod 84. Inside of the discharge column 83 is formed with a water passage 831 having a rear end opening. At least two opposing outlets 832 penetrate the discharge column 83 are provided in front of the water flow passage 831, and a spout 90 is screwed onto one end of discharge column 83. The rotation of the spout 90 is used to change the size of the gap between a front stepped rod 833 of the discharge column 83, the spout 90 and a tapered outlet 91 and to be used to adjust the shape of the water spray so that the water flow can concentrate as shown in FIG. 6, or to form a trumpet-like diffuse spray as shown in FIG. 7.

However, there are still the following problems in the practical application of the conventional structure: the spout 90 and valve rod 84 are completed by the metal copper ingot, so the required cost is high and the overall weight of the heavier.

Therefore, it is desirable to provide a spray head to mitigate and/or obviate the aforementioned problems.

SUMMARY OF INVENTION

An objective of present invention is to provide a spray head which is lightweight and low manufacture cost.

In order to achieve the above mentioned objective, a spray head includes a main body, a central shaft, a securing ring, a spout and a knob. The main body has a handle and a chamber, the chamber provided with a connecting opening allowing the central shaft to be inserted thereof, an inner sidewall of the connecting opening provided with a first threaded portion and a stepped edge. the central shaft has an assembly portion, a connecting section and a sleeve all as a single piece, the assembly portion protruding from a side of the connecting section opposite the sleeve and having a threaded aperture at a center position, the sleeve further including a center aperture extending towards the assembly portion without connecting to the threaded aperture, and an end of the center aperture having more than one outlet through the assembly portion. A disk body is disposed between the connecting section and the sleeve, the central shaft entering into the main body through the connecting opening, and the sleeve inserted into the chamber and engaging with the stepped edge such that the connecting section extends out of the chamber, an outer edge of the connecting section extending out of the chamber provided with a second threaded portion for engaging with the spout. an outer portion of the securing ring is provided with a third thread portion engaging with the first threaded portion when the central shaft is inserted into the main body, such that the disk body is sandwiched between the securing ring and the stepped edge to secure the central shaft in the main body; an inner portion of the securing ring supports the central shaft and allows the connecting section and the assembly portion to protrude thereof. the spout is provided with an outer shell and an inner tube, and the inner tube has a fourth thread portion, wherein by engaging the fourth thread portion and the second threaded portion, the spout is able to engage with the connecting section of the central shaft, a front end of the inner tube having an enlarged stepped section connected to a cone. The knob has a stopper, and an end of the stopper has a screw, the screw of the knob inserted from the cone of the spout and engaging with the threaded aperture of the inner tube of the central shaft.

Other objects, advantages, and novel features of invention will become more apparent from the following detailed description when taken in conjunction with the accompanying drawings.

DETAILED DESCRIPTION OF PREFERRED EMBODIMENT

Figure 1:
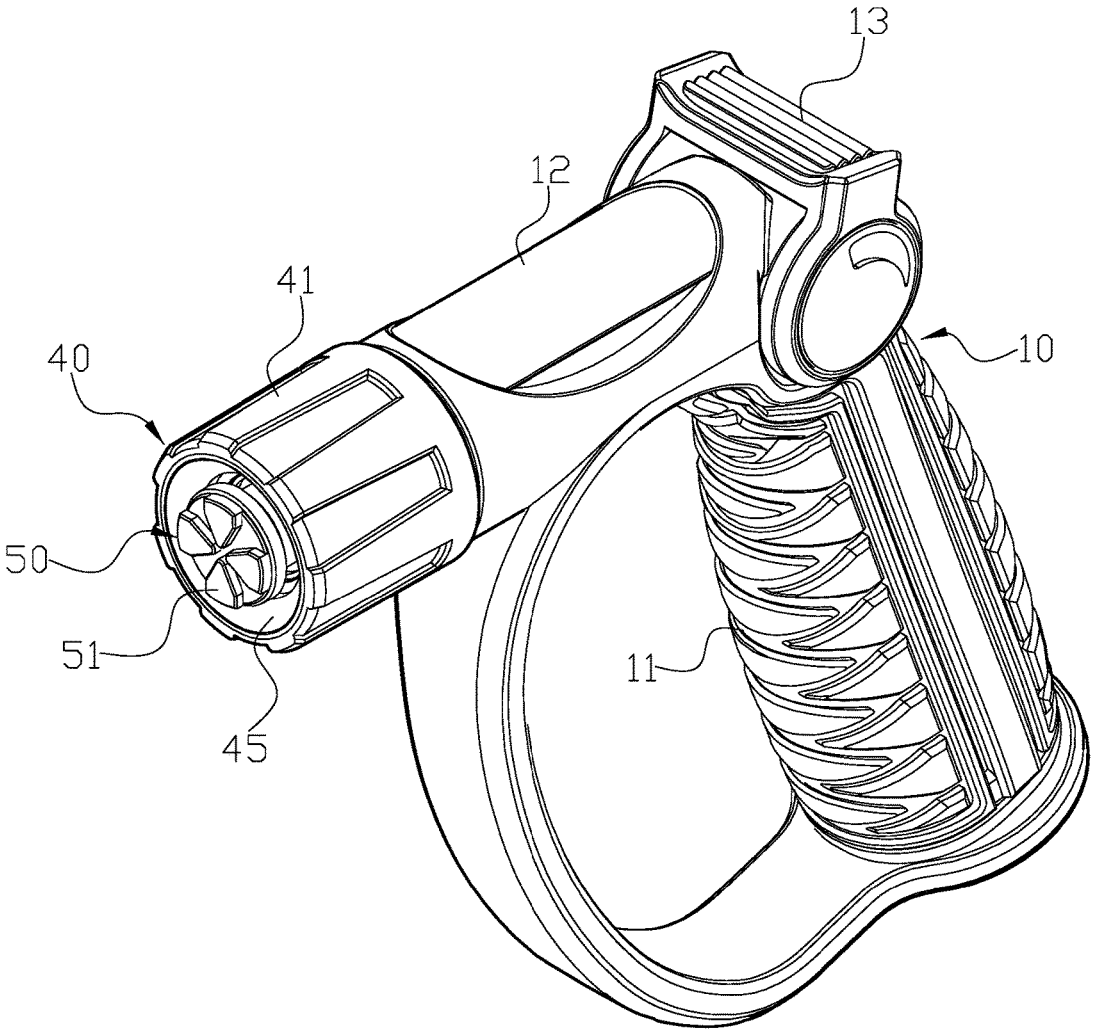
FIG. 1 is a perspective assembly drawing of a preferred embodiment of the present invention.
Figure 2:
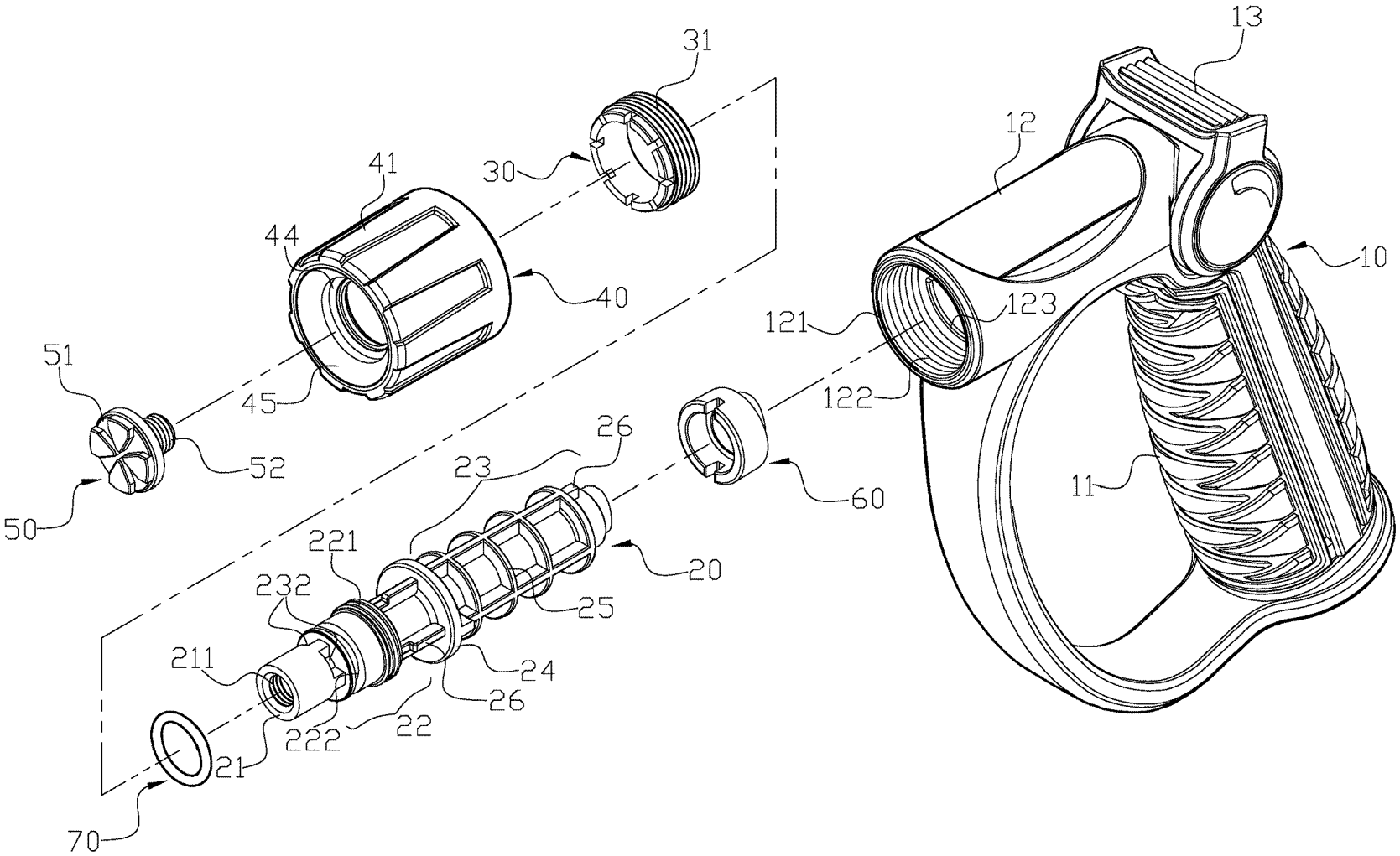
FIG. 2 is an exploded drawing of the preferred embodiment of the present invention.
Figure 3:
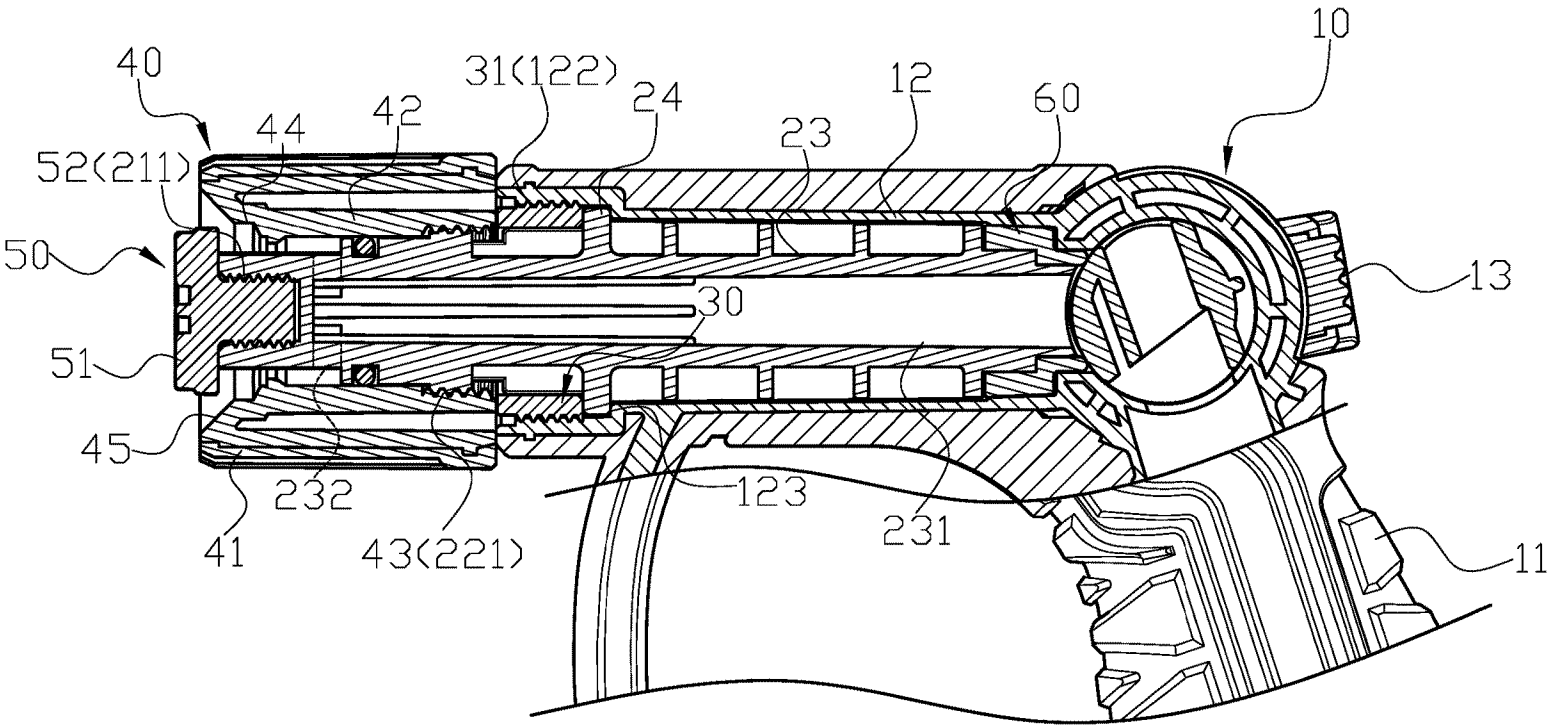
FIG. 3 is a cross-sectional view of the preferred embodiment of the present invention.
Figure 4:
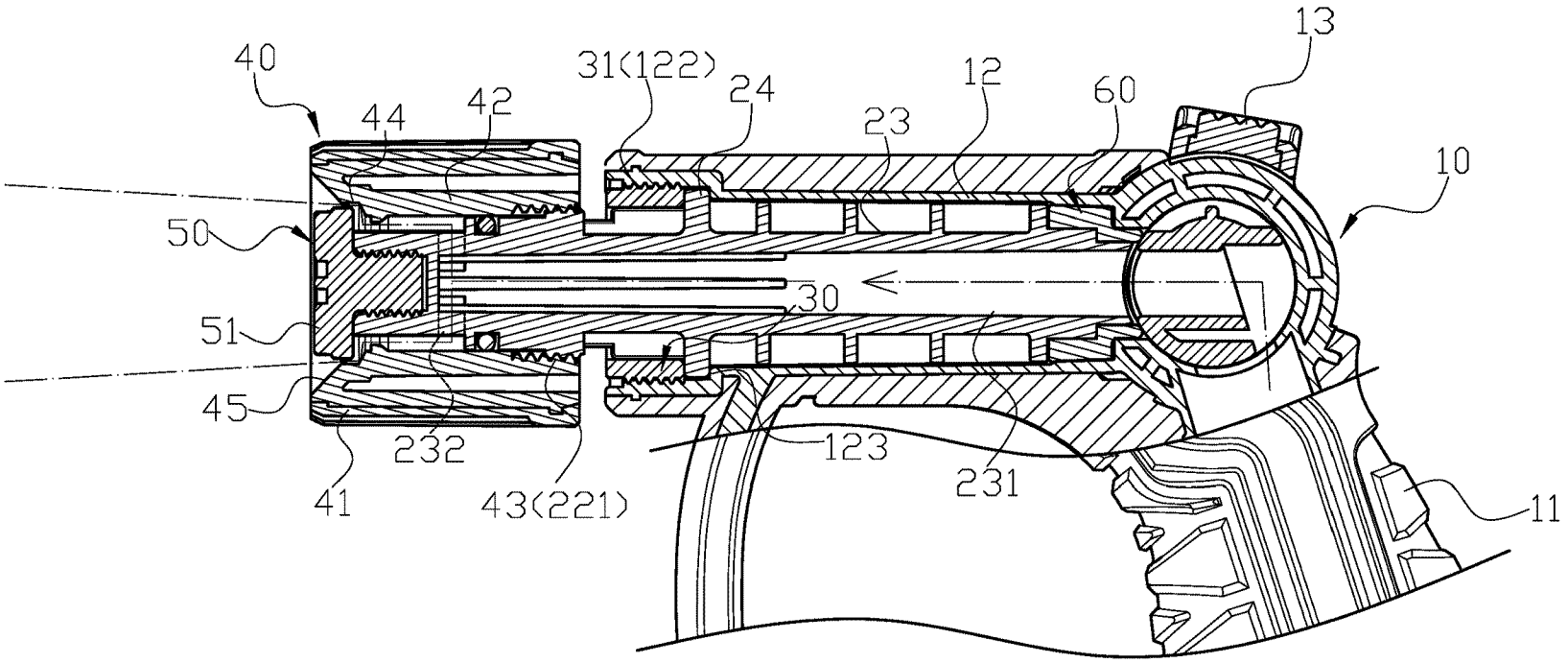
FIG. 4 shows a straight water stream outputted from the preferred embodiment of the present invention.
Figure 5:
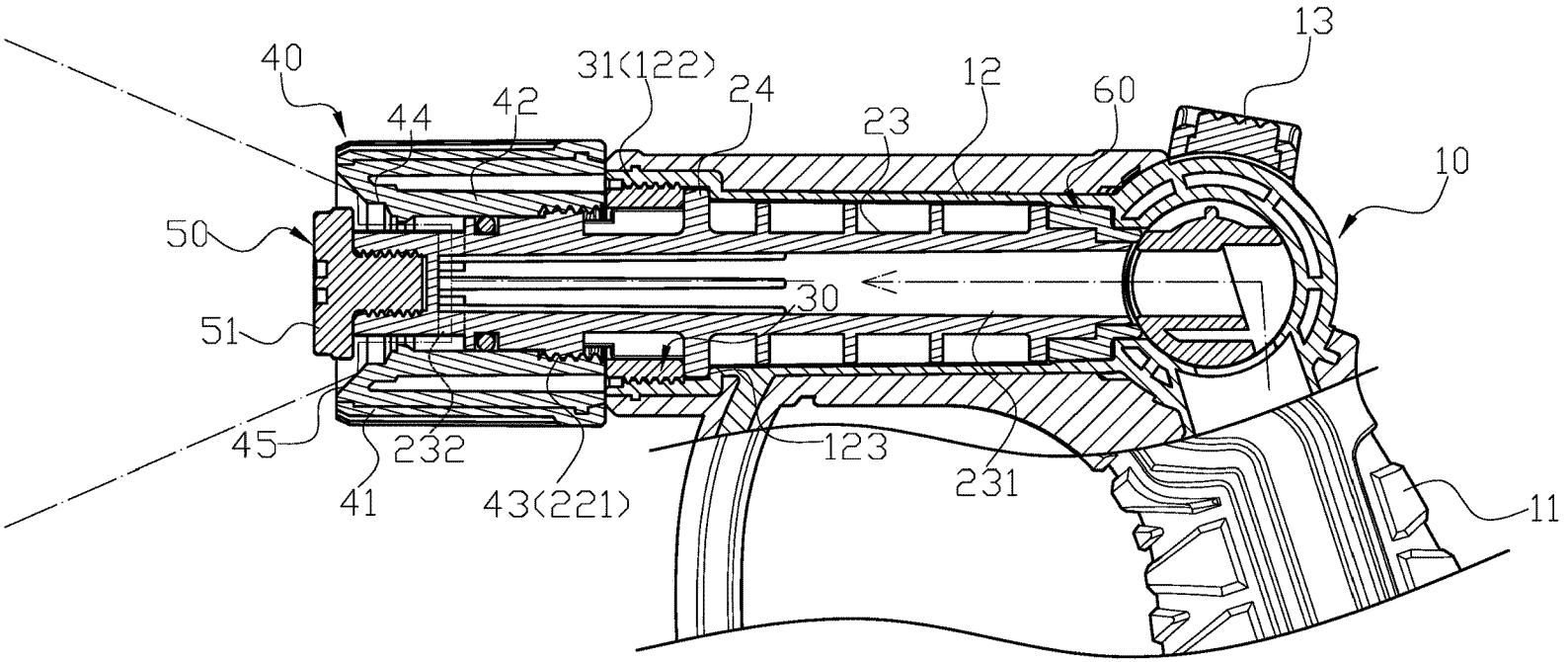
FIG. 5 shows a diffuse water spray outputted from the preferred embodiment of the present invention.
Figure 6:
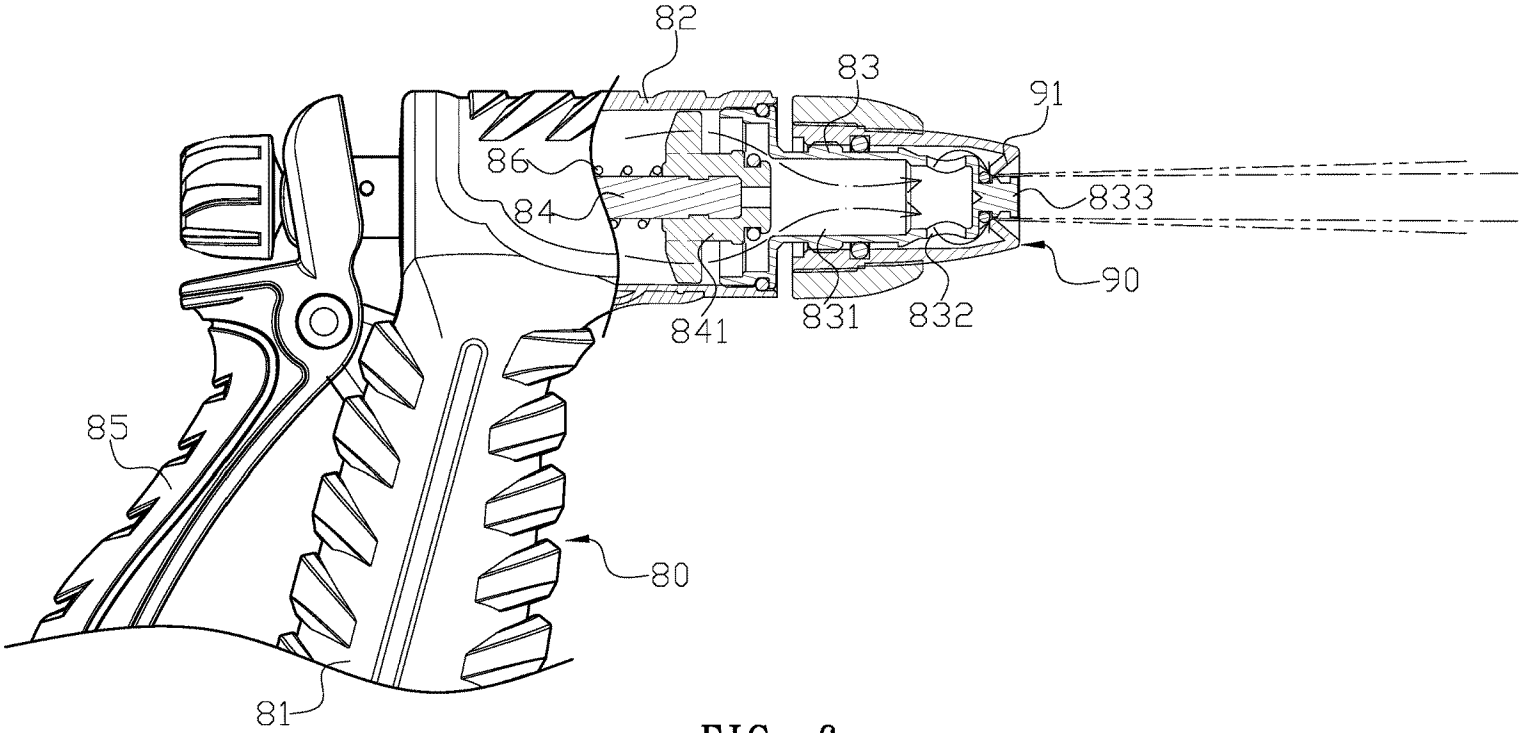
FIG. 6 PRIOR ART
FIG. 6 is a schematic drawing of a conventional spray head outputting a straight water stream.
Figure 7:
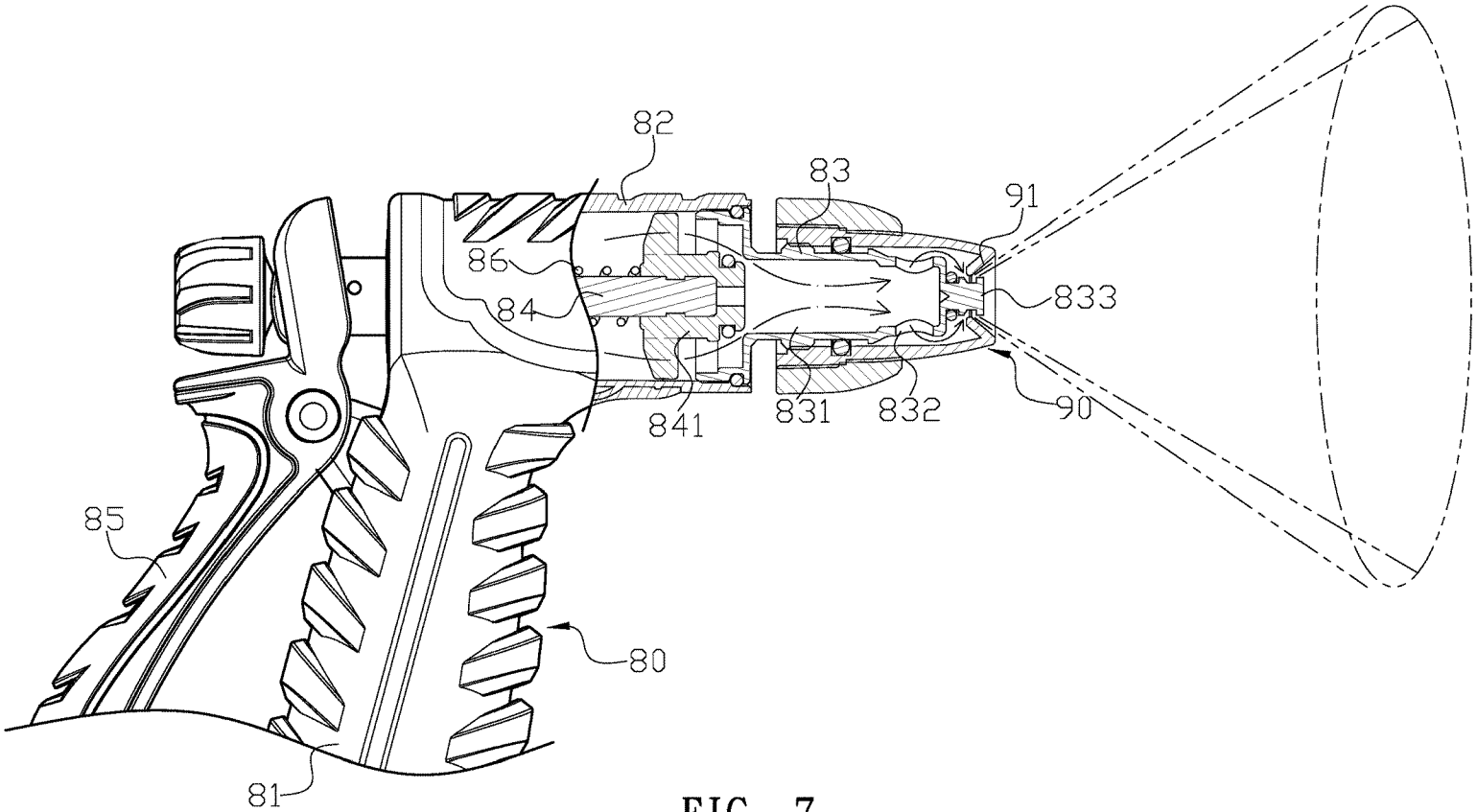
FIG. 7 PRIOR ART
FIG. 7 is a schematic drawing of a conventional spray head outputting a diffuse water spray.

Please refer to FIG. 1, FIG. 2 and FIG. 3. A spray comprises a main body 10, a central shaft 20, a securing ring 30, a spout 40 and a knob 50. The main body 10 has a handle 11 and a chamber 12. The chamber 12 is provided with a connecting opening 121 allowing the central shaft 20 to be inserted thereof, and an inner sidewall of the connecting opening 121 is provided with a first threaded portion 122 and a stepped edge 123. The central shaft 20 is made of plastic injection molding and has an assembly portion 21, a connecting section 22 and a sleeve 23 all as a single piece. The assembly portion 21 protrudes from a side of the connecting section 22 opposite the sleeve 23 and has a threaded aperture 211 at a center position. The sleeve 23 further includes a center aperture extending towards the assembly portion 21 without connecting to the threaded aperture 211 and an end of the center aperture 231 has at least two outlets 232 through the assembly portion 21. A disk body 24 is disposed between the connecting section 22 and the sleeve 23. The central shaft 20 enters into the main body 10 through the connecting opening 121, and the sleeve 23 is entirely inserted into the chamber 12 and engages with the stepped edge 123 such that the connecting section 22 extends out of the chamber 12. An outer edge of the connecting section 22 extending out of the chamber is provided with a second threaded portion 221 for engaging with the spout 40. An outer portion of the securing ring 30 is provided with a third thread portion 31 engaging with the first threaded portion 122 when the central shaft 20 is inserted into the main body 10, such that the disk body 24 is sandwiched between the securing ring 30 and the stepped edge 123 to secure the central shaft 20 in the main body 10. An inner portion of the securing ring 30 supports the central shaft 20 and allows the connecting section 22 and the assembly portion 21 to protrude thereof. The spout 40 is made of plastic injection molding and provided with an outer shell 41 and an inner tube 42, and the inner tube 42 has a fourth thread portion 43. By engaging the fourth thread portion 43 and the second threaded portion 221, the spout 40 is able to engage with the connecting section 22 of the central shaft 20. A front end of the inner tube 42 has an enlarged stepped section 44 connected to a cone 45. The knob 50 has a stopper 51, and an end of the stopper 51 has a screw 52. The screw 52 of the knob 50 is inserted from the cone 45 of the spout 40 and engages with the threaded aperture 211 of the inner tube 42 of the central shaft 20.

Furthermore, a trigger valve 13 is disposed between the handle 11 and the chamber 12 of the main body 10, and the trigger valve 13 is configured for controlling the main body 10.

A plurality of circular ribs 25 and linear ribs 26 are crossly disposed on an outer periphery of the central shaft 20 for increasing strength of the central shaft 20.

In the preferred embodiment, the sleeve 23 is jacketed with a stopping member 60, and the stopping member 60 is a hollow stepped sleeve.

Moreover, the connecting section further includes at least one circular groove.

The connecting section 22 further includes at least one circular groove 222 for accepting a seal ring 70.

For actual operation, water enters through the handle 11, the chamber 12 and the center aperture 231 into the central shaft 20 and exits from the outlet 232. By rotating the spout 40 clockwise or counter-clockwise, the stopper 51 can be aligned with the stepped section 44 or the cone 45, and water hits the stepped section 44 or the cone 45 to provide different water streams.

With the above mentioned structure, following benefits can be obtained: the central shaft 20 and the spout 40 can be made of plastic injecting mold, which can be low cost, low weight. Also, the sleeve 23 of the central shaft 20 is disposed in the chamber 12 of the main body 10 and extends to a conjunction between the handle 11 and the chamber 12, which can increase stability of the central shaft 20.

Although the present invention has been explained in relation to its preferred embodiment, it is to be understood that many other possible modifications and variations can be made without departing from the spirit and scope of invention as hereinafter claimed.

What is claimed is:

1. A spray head comprising:

a main body, a central shaft, a securing ring, a spout and a knob, wherein:

the main body has a handle and a chamber, the chamber provided with a connecting opening allowing the central shaft to be inserted thereof, an inner sidewall of the connecting opening provided with a first threaded portion and a stepped edge;

the central shaft has an assembly portion, a connecting section and a sleeve all as a single piece, the assembly portion protruding from a side of the connecting section opposite the sleeve and having a threaded aperture at a center position, the sleeve further including a center aperture extending towards the assembly portion without connecting to the threaded aperture, and an end of the center aperture having more than one outlet through the assembly portion;

a disk body is disposed between the connecting section and the sleeve, the central shaft entering into the main body through the connecting opening, and the sleeve inserted into the chamber and engaging with the stepped edge such that the connecting section extends out of the chamber, an outer edge of the connecting section extending out of the chamber provided with a second threaded portion for engaging with the spout;

an outer portion of the securing ring is provided with a third thread portion engaging with the first threaded portion when the central shaft is inserted into the main body, such that the disk body is sandwiched between the securing ring and the stepped edge to secure the central shaft in the main body; an inner portion of the securing ring supports the central shaft and allows the connecting section and the assembly portion to protrude thereof;

the spout is provided with an outer shell and an inner tube, and the inner tube has a fourth thread portion, wherein by engaging the fourth thread portion and the second threaded portion, the spout is able to engage with the connecting section of the central shaft, a front end of the inner tube having an enlarged stepped section connected to a cone; and the knob has a stopper, and an end of the stopper has a screw, the screw of the knob inserted from the cone of the spout and engaging with the threaded aperture of the inner tube of the central shaft.

2. The spray head as claimed in claim 1, wherein a trigger valve is disposed between the handle and the chamber of the main body.

3. The spray head as claimed in claim 1, wherein an end of the center aperture is further provided with at least two opposing outlets radially passing through the assembly portion.

4. The spray head as claimed in claim 1, wherein a plurality of circular ribs and linear ribs are crossly disposed on an outer periphery of the central shaft for increasing strength of the central shaft.

5. The spray head as claimed in claim 1, wherein the sleeve is jacketed with a stopping member.

6. The spray head as claimed in claim 1, wherein the stopping member is a hollow stepped sleeve.

7. The spray head as claimed in claim 1, wherein the connecting section further includes at least one circular groove.

* * * * *